US006179274B1

(12) United States Patent
Irwin, III

(10) Patent No.: US 6,179,274 B1
(45) Date of Patent: Jan. 30, 2001

(54) SUPPORT POST SYSTEM

(76) Inventor: Albert J. Irwin, III, R.R. 1, Box 96, Saltsburg, PA (US) 15681

( * ) Notice: Under 35 U.S.C. 154(b), the term of this patent shall be extended for 0 days.

(21) Appl. No.: 08/928,681

(22) Filed: Sep. 12, 1997

Related U.S. Application Data

(63) Continuation of application No. 08/661,695, filed on Jun. 11, 1996, now abandoned.

(51) Int. Cl.[7] ..... E04H 17/14

(52) U.S. Cl. ..... 256/65; 256/26; 256/73

(58) Field of Search ..... 256/19, 59, 65, 256/60, 67–69, 73, 24, 26, 32, 25, 63, 64; 248/218.4, 220.1; 403/403, 205, 4

(56) References Cited

U.S. PATENT DOCUMENTS

| | | | | |
|---|---|---|---|---|
| 54,772 | * | 5/1866 | Reedy | 256/59 |
| 183,601 | * | 10/1876 | Stover | 256/65 X |
| 211,442 | * | 1/1879 | Vacaro | 256/65 |
| 234,692 | * | 11/1880 | Shields | 256/65 |
| 365,099 | * | 6/1887 | Richart | 256/69 |
| 399,021 | * | 3/1889 | Dailey | 256/65 X |
| 473,092 | * | 4/1892 | Snowden et al. | 256/24 |
| 540,936 | * | 6/1895 | Williams | 256/69 |
| 591,000 | * | 10/1897 | Morris | 256/26 |
| 673,484 | * | 5/1901 | Soles | 256/65 X |
| 799,413 | * | 9/1905 | Spencer | 256/69 |
| 968,908 | * | 8/1910 | Williamson | 256/65 X |
| 1,636,189 | * | 7/1929 | Louden | 256/24 |
| 1,647,406 | * | 11/1927 | Henry | 256/73 |
| 1,867,107 | * | 7/1932 | Schmidt, Jr. | 403/205 |
| 1,950,965 | * | 3/1934 | Blackburn | 256/65 X |
| 2,528,358 | * | 10/1950 | Grass | 256/65 X |
| 2,718,382 | * | 9/1955 | Bird | 256/19 |
| 2,906,551 | * | 9/1959 | May | 256/65 X |
| 3,107,900 | * | 10/1963 | De Paolo | 256/59 X |
| 3,604,687 | * | 9/1971 | Moore | 256/68 X |
| 3,617,028 | * | 11/1971 | Bach et al. | 256/19 |
| 3,648,982 | * | 3/1972 | Sabel et al. | 256/65 |
| 4,067,547 | * | 1/1978 | Peters | 256/25 X |
| 4,142,711 | * | 3/1979 | Brimhall | 256/19 X |
| 4,298,291 | * | 11/1981 | Ward, Jr. | 403/205 |
| 5,277,408 | * | 1/1994 | Parker | 256/67 X |
| 5,297,890 | * | 3/1994 | Commins | 256/69 X |
| 5,676,486 | * | 10/1997 | Keith | 403/205 X |

FOREIGN PATENT DOCUMENTS

| | | | | |
|---|---|---|---|---|
| 127429 | * | 6/1919 | (GB) | 256/19 |
| 77013 | * | 6/1950 | (NO) | 256/32 |

* cited by examiner

*Primary Examiner*—Harry C. Kim
(74) *Attorney, Agent, or Firm*—Bartony Hare & Edson

(57) ABSTRACT

The present invention provides generally a support post system comprising a support member. The support member comprises at least one recess in a surface of the support member for receiving a rail member. The support post further comprises at least one attachment member which extends outwardly substantially perpendicular to the longitudinal axis of the support member. The attachment member extends through the recess. The support post system further comprises a finish plate for being placed over the rail member when after the rail member is seated in the recess. The finish plate has a passage formed therein to allow passage of the attachment member therethrough. The support post system also comprises a mechanism for removably securing the finish plate to the attachment member.

9 Claims, 10 Drawing Sheets

SUPPORT POST SYSTEM

This is a continuation of application Ser. No. 08,661,695, filed Jun. 11, 1996, now abandoned.

FIELD OF THE INVENTION

The present invention relates to a support post system, and, particularly, to a support post system for use in construction of fences and walls for various purposes.

BACKGROUND OF THE INVENTION

Post-supported fences and walls have been used in numerous settings for hundreds of years. In such fences or walls, substantially horizontal rails are supported by substantially vertical posts. Generally, the supporting posts of such fences are buried into the ground.

The posts for early post-supported fences and walls were fabricated largely if not entirely from wood. Unfortunately, wood is adversely affected by environmental conditions over a relatively short period of time, especially when buried in the ground. Recently, therefore, wooden posts have been replaced in many instances by concrete or metallic posts better suited to withstand the extremes of temperature and moisture required of an outdoor system.

In the past it also has been very difficult to construct post-supported fences and walls and to replace damaged rails in post-supported fences or walls. In many cases it was necessary to remove the post adjacent a damaged rail from the ground to repair or replace the damaged rail. In an attempt to facilitate the construction of fences and walls and to facilitate the repair thereof, a number of modular fencing systems have been proposed.

Nonetheless, the modular systems currently available suffer from a number of significant drawbacks. For example, such systems are often difficult to assemble. Moreover, it is often difficult to lay out such modular systems in a desired geometric arrangement. Still further, many such modular systems are not sturdy enough for use in many settings.

It is, therefore, desirable to develop a support post and support post system that minimizes or eliminates these and other drawbacks associated with current posts and support post systems.

SUMMARY OF THE INVENTION

The present invention provides generally a support post system comprising a support member having at least one recess in a surface of the support member for receiving and seating a rail member. The support member further comprises at least one attachment member which extends outwardly substantially perpendicular to the longitudinal axis of the support member. The attachment member extends through the recess and preferably beyond the surface of the support member. In one embodiment, the attachment member passes through a corresponding passage in the rail member when the rail member is seated in the recess. The rail may be seated in the recess without the attachment member passing through the rail member, however. The support post system further comprises a finish plate for placement over the rail member after the rail member is seated in the recess. The finish plate has a passage formed therein to allow passage of the attachment member therethrough. The support post system also comprises means for removably securing the finish plate to the attachment means.

DETAILED DESCRIPTION OF THE INVENTION

Figure 2:
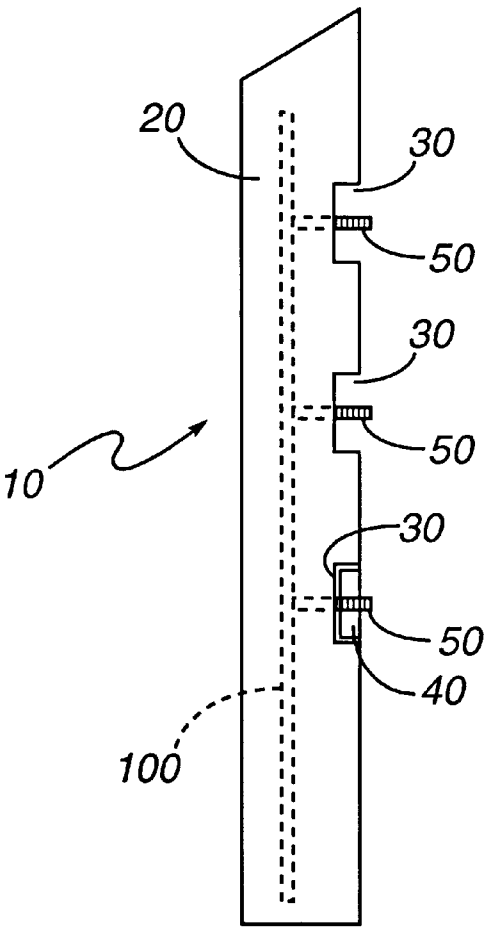
FIG. 2 illustrates a side view of the embodiment of FIG. 1.
Figure 1:
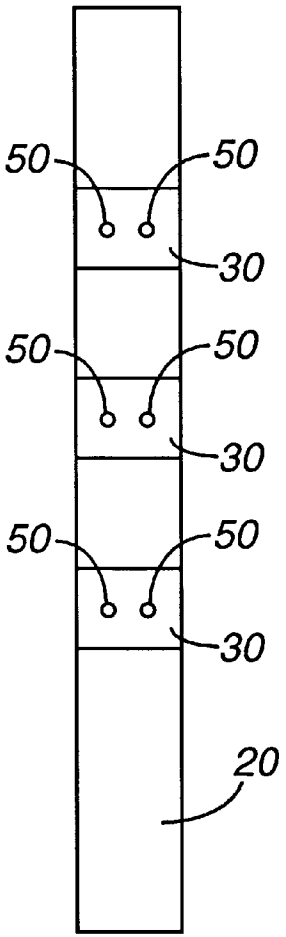
FIG. 1 illustrates a front view of an embodiment of a support post system under the present invention.

As illustrated in FIGS. 1 and 2, support post system 10 preferably comprises a support member 20 having at least one recess 30 therein. In the embodiment illustrated in FIGS. 1 and 2, support member 20 has a substantially rectangular cross-sectional shape and comprises three recesses 30 on one of its four sides. For maximum strength and facility of construction, recesses 30 are preferably rectangular grooves of an appropriate width and depth to seat a rail member 40 of rectangular cross section (see FIGS. 1 and 2) therein. As clear to one skilled in the art, however, support member 40 can have any of a number of cross-sectional shapes. Likewise, recesses 40 can be of substantially any cross-sectional shape corresponding to the cross-sectional shape of rail member 40 to be seated therein.

Figure 4:
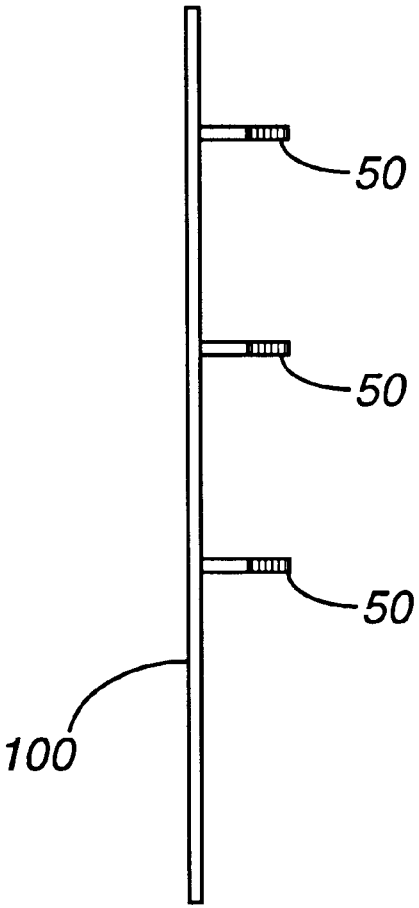
FIG. 4 illustrates a side view of the reinforcement member of FIG. 3.
Figure 3:
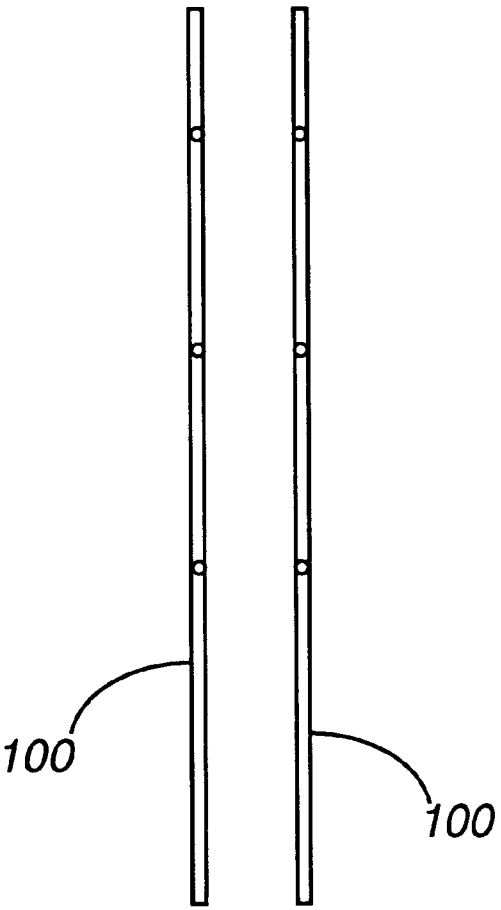
FIG. 3 illustrates a front view of an embodiment of reinforcement members for use in the support members of the present invention.

Each recess 30 includes at least one attachment member 50 extending therethrough, which may, for example, comprise a bolt. Preferably, at least two attachment members 50 are included in each recess. Support member 20 is preferably fabricated from a strong and durable material such as steel reinforced concrete or fiberglass. Most preferably, support member 20 is fabricated from steel reinforced concrete. As best illustrated in FIGS. 2 through 4, support member 20 may, for example, comprise one or more steel reinforcement rods 100 longitudinally oriented within the interior of support member 20. Reinforcement rods 100 may be placed within concrete support member 20 using well known concrete molding techniques. Preferably, at least two reinforcement rods 100 are included. To increase the strength of attachment of rail members 40 to support members 20, attachment members 50 are preferably attached to enforcement rods 100. Attachment members 50 comprising metallic bolts, for example, may be welded to reinforcement rods 100 before support member 20 is molded.

Figure 5A:
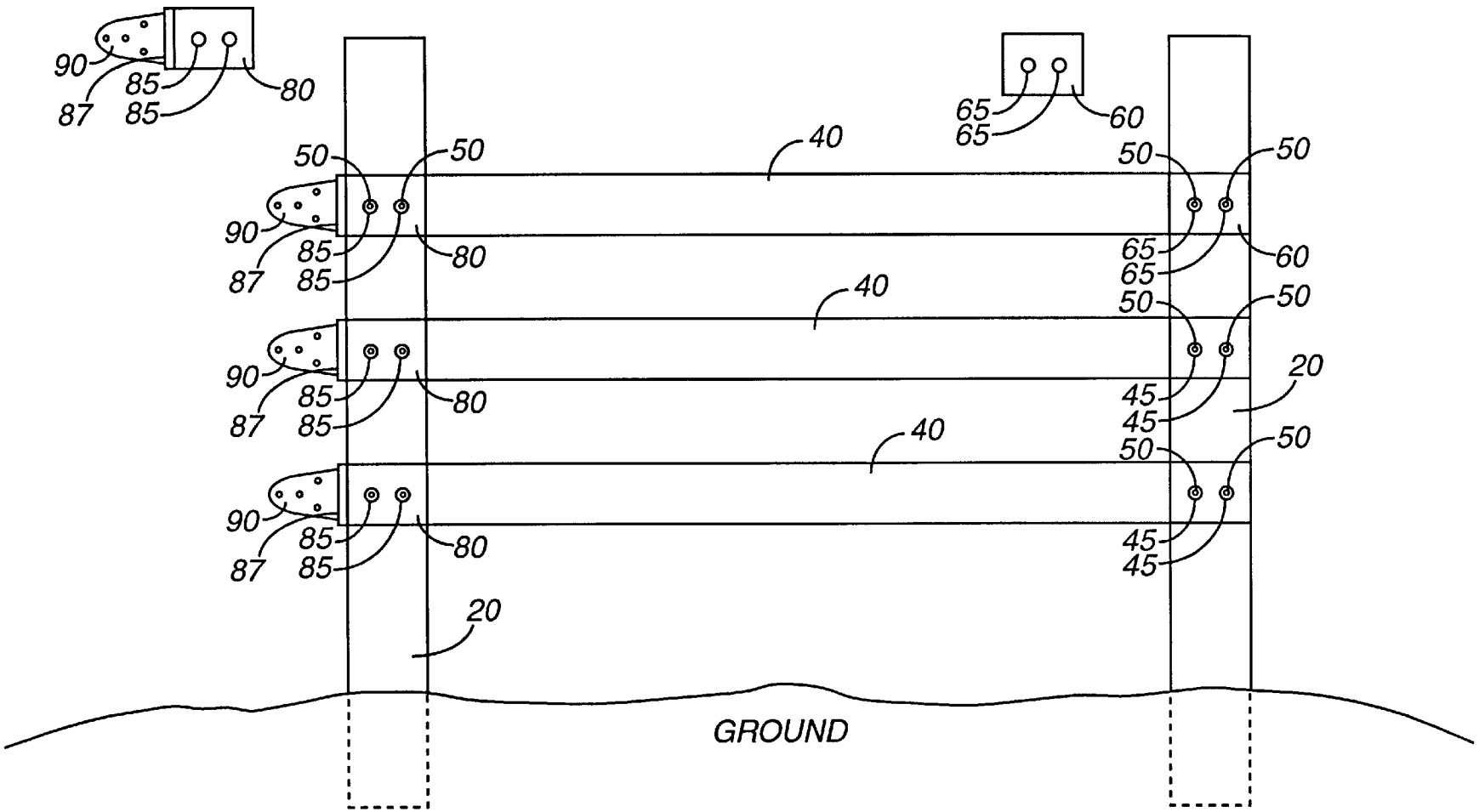
FIG. 5A illustrates a front view of an embodiment of a fence system of the present invention.

As best illustrated in FIG. 5A, support members 20 are preferably anchored at desired positions by, for example, being buried in the ground. Rail members 40 are then seated in recesses 30 with each rail member 40 preferably being supported by at least one support member 20. At the position where a rail member 40 is seated in a recess 30, one or more passages 45 may be formed in rail member 40 through which attachment members 50 may pass. Alternatively, the ends of rail members 40 may simply be seated in recesses 30 without attachment member 40 passing therethrough (see FIG. 5C).

Figure 5B:
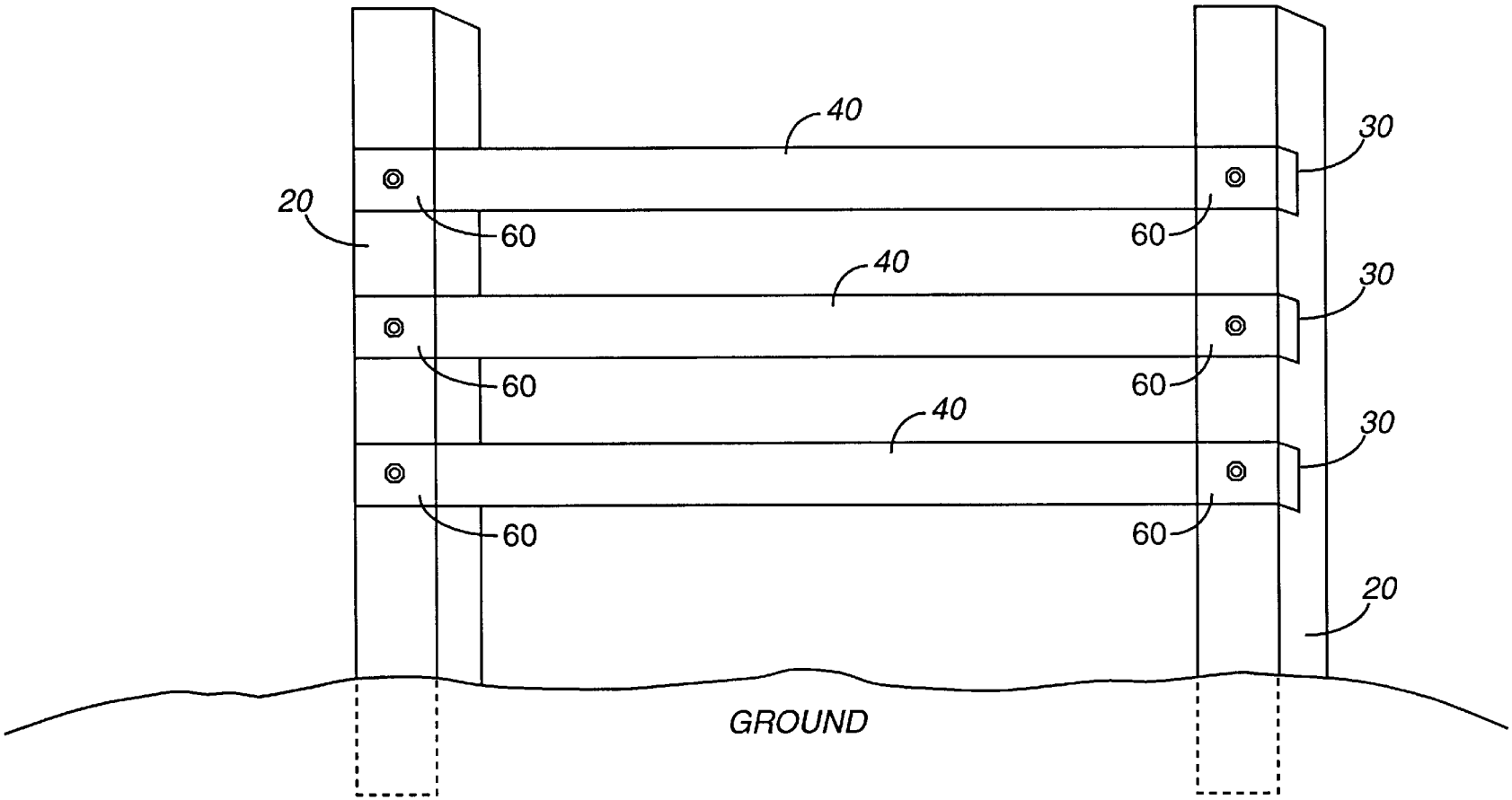
FIG. 5B illustrates a side perspective view of an embodiment of a fence system of the present invention.

After rail member 40 is seated in recess 30 of support member 20, a finish plate 60 is placed over rail member 40 and secured to support member 20 as best illustrated in FIG. 5A. Preferably, finish plate 60 is shaped to conform to the surface of rail member 40. In the case of a rectangular rail member, for example, finish plate is preferably substantially flat. Likewise, finish plate 60 may be curved if the surface or rail member 40 is curved. Finish plate 60 includes means for removably attaching finish plate 60 to attachment member 50. Preferably, finish plate 60 includes one or more passages 65 therethrough to allow attachment means 50 to pass through passages 65. In the case of threaded bolts used for attachment means 50, a nut 70 (see FIG. 5B) as known in the art may be used to secure finish plate 60 (and thereby rail member 40) to support member 20. Preferably, finish plate 60 is fabricated from a strong, durable material such as steel and acts to securely maintain rail member 40 within recess 30.

Figure 6A:
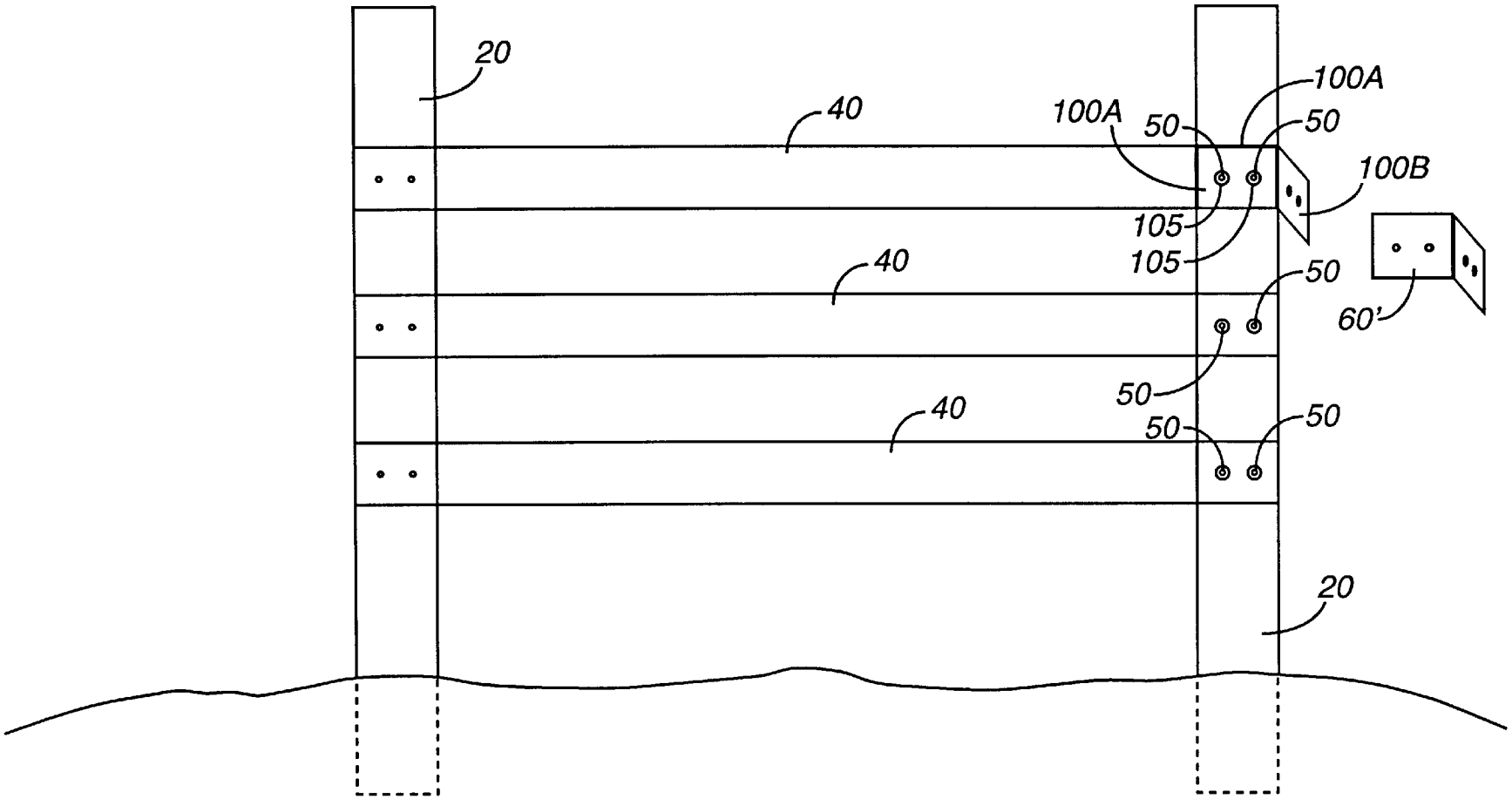
FIG. 6A illustrates an embodiment of a fence system of the present invention have an angled connection plate.

As best illustrated in FIGS. 5A and 6A, the installation of a hinged gate or creation of an angle in a fence or wall is very simple with the present system. In that regard, FIG. 5A illustrates a hinge plate 80 that is (for durability) preferably placed in recess 30 of support member 20 before rail member 40 is placed therein. Hinge plate 80 preferably has one or more passages 85 to allow attachment members 50 to pass therethrough. After hinge plate 80 is set in place in recess 30, rail member 40 is then set in place within recess 30 over hinge plate 80. A finish plate 60 is then placed over rail member 40 and secured to support member 20 via attachment means 50. Hinge plate 80 includes a hinged portion 90 attached to hinge plate 80 via a hinge 87. A swinging gate may be attached to hinge portion 90 as known in the art. A hinged portion may alternatively be attached to finish plate 60 for supporting a hinged gate or door.

Similarly, an angle θ may easily be created in a fence or wall under the present invention with used of an angled plate 110. In the case that rail members 40 are of a rectangular cross-section, angled plate 110 preferably comprises a first substantially flat surface 110A and a second substantially flat surface 110B. Surfaces 110A and 110B form angle θ therebetween. Surface 110A is preferably provided with one or more passages 105 and seated in recess 30. Attachment member(s) 50 pass through passages 105. After surface 110A of angled plate 110 is set in place within recess 30, rail member 40 is placed thereover. Second surface 110B acts as a support for a further rail member 40, which, when attached to second surface 110B through any means known in the art (for example, bolts and nuts) forms approximately an angle θ with respect to first surface 110A and the rail member attached thereto. To provide strength to the angled attachment, an angled finish plate 60' is preferably set in place last to secure the angled attachment. As clear to one of ordinary skill in the art, an angled connection can also be made in the present system with use of angled finish plate 60' without the use of angled plate 110. Moreover, angled plate and angled finish plate are easily formed to any angle θ (for example, by bending metallic plates).

Figure 6B:
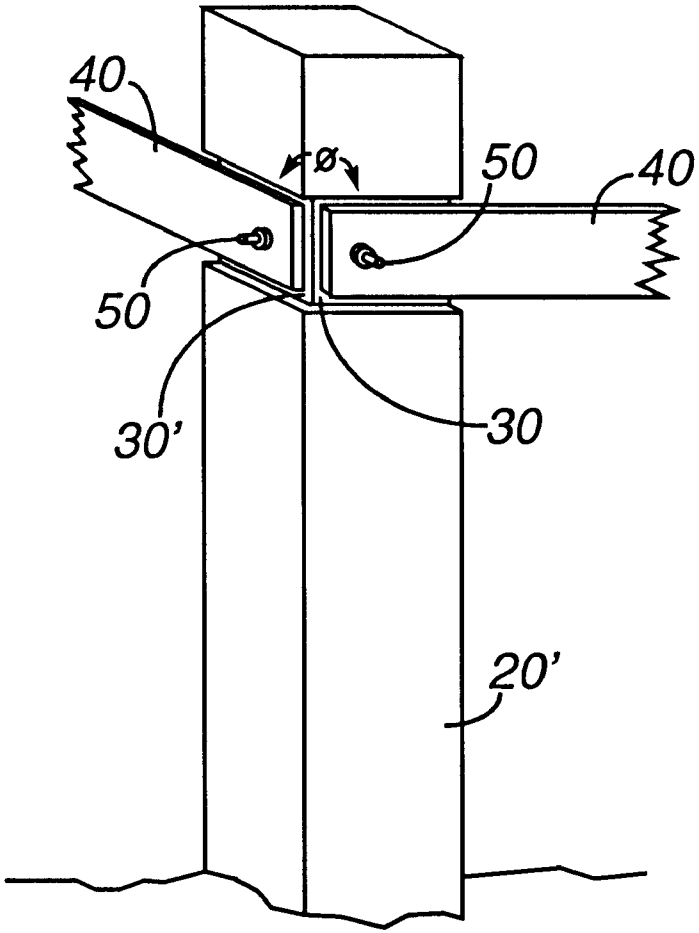
FIG. 6B illustrates an embodiment of a support member having recesses in more than one side thereof for creating an angle in a fence system.

FIG. 6B illustrates another manner in which an angle in a fence system of the present invention can be made. In the fence system illustrated in FIG. 6B, rails members 40 are placed in recesses 30 and 30' which are formed in the exterior sides of support member 20'. Recesses 30 and 30' form an angle ϕ therebetween, thereby forming the angle ϕ in the fence system. As clear to one of skill in the art, support member 20' may easily be constructed to form a wide range of angles ϕ.

Figure 5C:
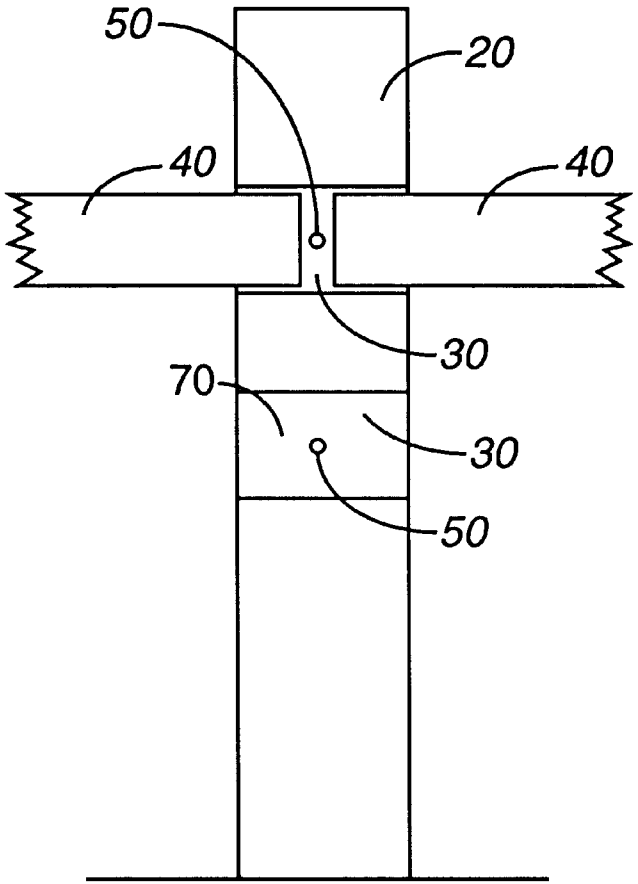
FIG. 5C illustrates a front view of an embodiment of a fence system of the present invention.
Figure 7A:
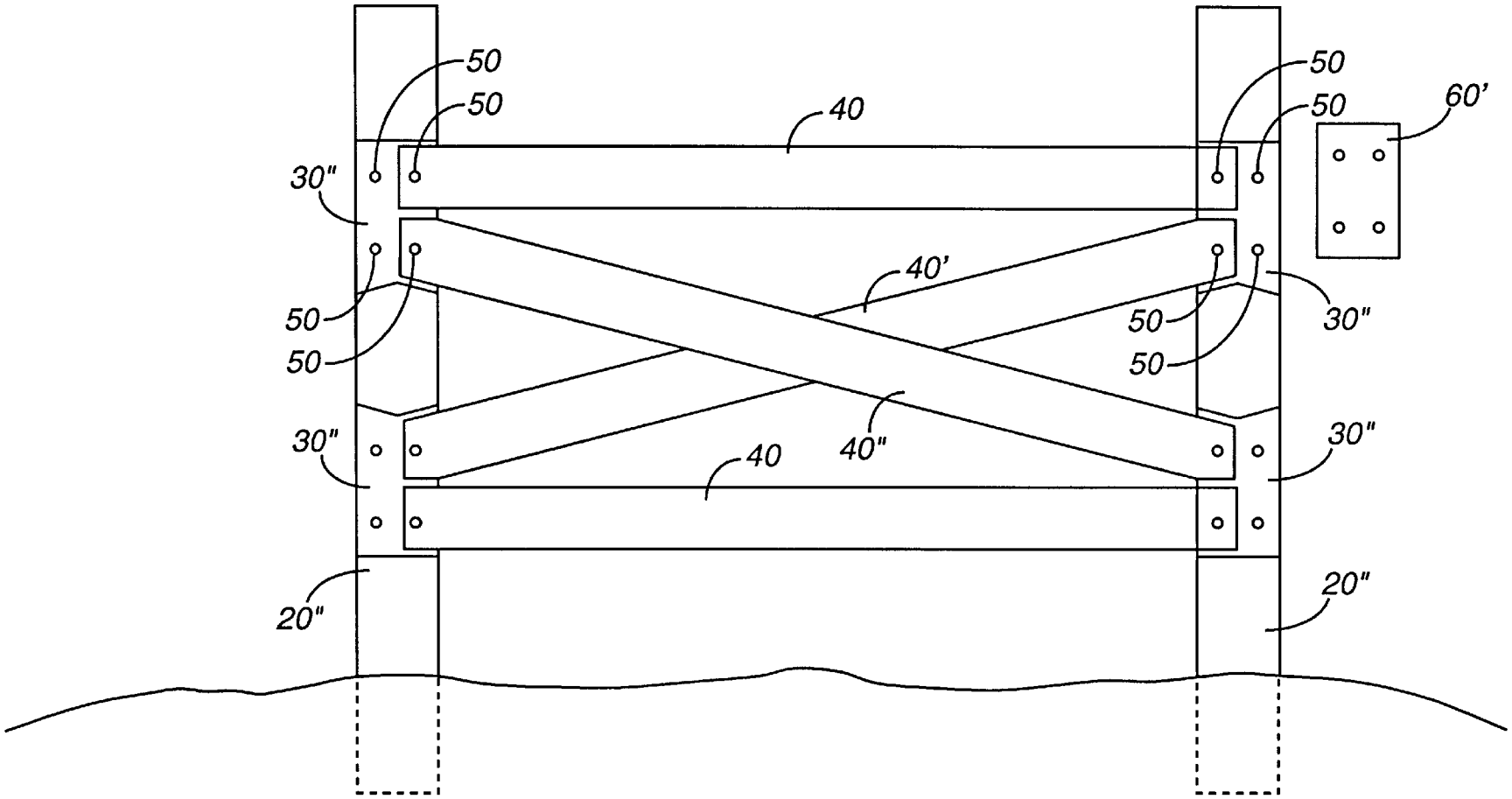
FIG. 7A illustrates an embodiment of a cross rail fence system of the present invention.
Figure 7B:
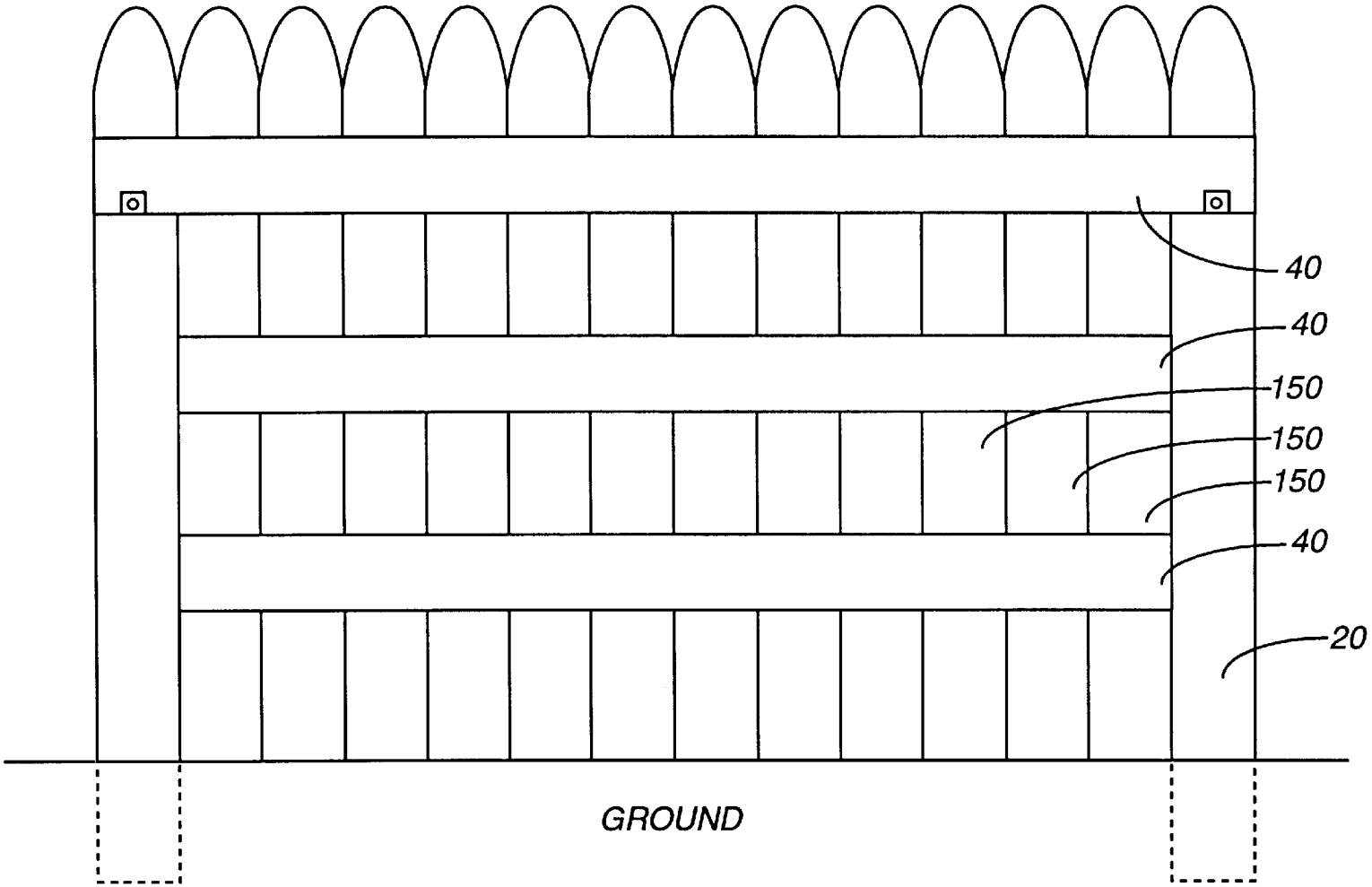
FIG. 7B illustrates an embodiment of a privacy fence system of the present invention.
Figure 7C:
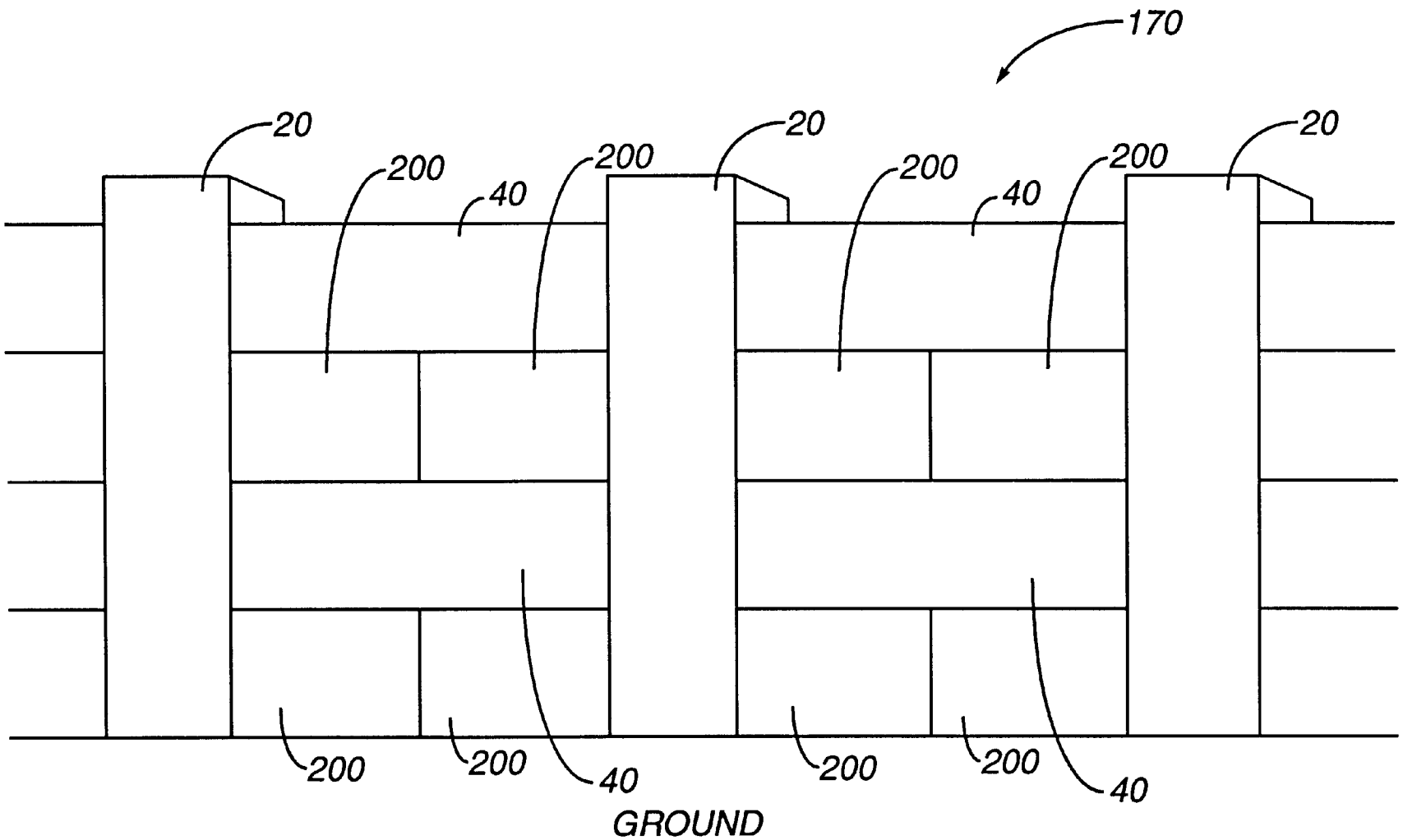
FIG. 7C illustrates and embodiment of a landscaping or retention wall incorporating an embodiment of a support member of the present invention

FIGS. 7A through 7C provide a number of examples of the aesthetic and utilitarian versatility of the present system. FIG. 7A illustrates a cross rail design in which cross rails 40" have been attached to support members 20" as have been rail members 40'. As illustrated in FIG. 7A, recesses 30" are appropriately shaped to accommodate the ends of rail members 40' and of cross rail members 40". Finish plate 60' is placed over recess 30" to secure rail members 40' and cross rail members 40" within recess 30". In the embodiment of FIG. 7A, attachment members 50 are shown to pass through rail members 40' and cross rail members 40". As illustrated in FIG. 5C, however, rail members 40' and cross rail members 40" may be seated in recesses 30" in a manner such that the one or more attachment member passing through recesses 30" do not pass through rail members 40' or cross rail members 40".

FIG. 7B illustrates a privacy wall or fence in which vertical planks 150 have been attached to rail members 40. FIG. 7C illustrates a landscaping wall 170 in which blocks 200 have been inserted between rail members 40. As clear to one skilled in the art, the dimensions of support members 20 and rail members 40 are easily adjustable to fit any situation. In the case that a large load must be supported by a fence or wall under the present invention, recesses 30 of support members 20 preferably face the direction from which the most force will be applied. In the case of a landscaping retaining wall, for example, recesses 30 preferably face the ground or soil to be retained. In the case of a livestock fence, for example, recesses 30 preferably face the interior of the fenced portion wherein the livestock is to be retained.

The fence systems of the present invention are also easily adaptable to an electric fence system for retention of livestock. In that regard, insulators (not shown) for supporting electrified wire (as well known in the art) are easily attached to support members 20 using methods well known in the art.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A support post system for attachment to at least a first rail member to construct a fence, the support post system comprising a support post member, the support post member having a recess formed in a surface thereof, the support post system further comprising a connector, the connector being fabricated from an integral piece of formable material, the connector having a flat first portion, the recess being adapted to seat the first portion of the connector therein, the first portion comprising an attachment mechanism for attaching the first portion to the support post member upon seating of the first portion in the recess, the connector further having a second portion, the second portion being bent relative to the first portion to extend away from the support post member at an alignment angle relative to the first portion, the second portion comprising a first rail attachment mechanism to attach the first rail member thereto such that the first rail member extends away from the support post member at substantially the alignment angle relative to the first portion.

2. The support post system of claim 1 wherein the connector is fabricated from a malleable metal.

3. A support post system for attachment to at least a first rail member to construct a fence, the support post system comprising a support post member, the support post member having a recess formed in a surface thereof, the support post system further comprising a connector, the connector being fabricated from an integral piece of formable material, the connector having a first portion, the recess being adapted to seat the first portion of the connector therein, the first portion comprising an attachment mechanism for attaching the first portion to the support post member upon seating of the first portion in the recess, the connector further having a second portion, the second portion being bent relative to the first portion to extend away from the support post member at an alignment angle relative to the first portion, the second portion comprising a first rail attachment mechanism to attach the first rail member thereto such that the first rail member extends away from the support post member at substantially the alignment angle relative to the first portion, the support post member further comprising at least one attachment member in the recess and a cover plate, the cover plate being adapted to be removably attached to the support post member via the attachment member to form a cover over the recess to secure the connector seated in the recess.

4. The support post system of claim 3 wherein the cover plate is fabricated from an integral piece of formable material comprising a first plate member, the first plate member forming the cover over the recess, the cover plate further comprising a second plate member, the second plate member being bent relative to the first plate member to form the alignment angle relative to the first plate member, the second plate member comprising second rail attachment mechanism for attaching the first rail member thereto, the first rail attachment mechanism of the second portion of the connector being adapted to attach to a first side of the first rail member, the second rail attachment mechanism of the cover plate being adapted to attach to a second, generally opposing side of the first rail member.

5. The support post system of claim 4 wherein the at least one attachment member of the support post member comprises a bolt extending through the recess of the support post member, the attachment mechanism of the first portion of the connector comprising a passage through which the bolt passes when the first portion is seated in the recess, the first plate member of the cover plate comprising a passage through which the bolt passes, the support post system further comprising a nut member to attach to the bolt to secure the connector and the cover plate to the support post member.

6. A method of attaching a rail member to a support post member in a fence system, the support post member having a recess formed in a surface thereof, the method comprising the following steps;

a. seating a flat first portion of a connector in the recess in the surface of the support post member to attach the first portion to the support post member, the connector being fabricated from an integral piece of formable material, the connector further comprising a second portion, the second portion being formed to extend away from the support post member at an alignment angle relative to the first portion, the second portion comprising a first rail attachment mechanism for attaching the rail member thereto; and b. attaching the rail member to the second portion of the connector such that the rail member extends away from the support post member at substantially the alignment angle relative to the first portion.

7. The method of claim 6 further comprising the step of c. before seating the first portion of the connector in the recess of the support post member, bending the second portion of the connector such that the second portion forms the alignment angle relative to the first portion of the connector.

8. The method of claim 7 wherein the connector is fabricated from a malleable metal.

9. A fencing system comprising a support post member and at least a first rail member, the support post member having a recess formed in a surface thereof, the support post system further comprising a connector, the connector being fabricated from an integral piece of formable material, the connector having a flat first portion, the recess being adapted to seat the first portion of the connector therein, the first portion comprising an attachment mechanism for attaching the first portion to the support post member upon seating of the first portion in the recess, the connector further having a second portion, the second portion being bent relative to the first portion to extend away from the support post member at an alignment angle relative to the first portion, the second portion comprising a first rail attachment mechanism, the first rail member being attached to the second portion to extend away from the support post member at substantially the alignment angle relative to the first portion.

* * * * *